US009856587B2

(12) United States Patent
Akita

(10) Patent No.: US 9,856,587 B2
(45) Date of Patent: Jan. 2, 2018

(54) ELASTIC CIRCULAR KNITTED FABRIC

(71) Applicant: Asahi Kasei Fibers Corporation, Osaka-shi, Osaka (JP)

(72) Inventor: Shoichi Akita, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 172 days.

(21) Appl. No.: 14/904,125

(22) PCT Filed: Jul. 10, 2014

(86) PCT No.: PCT/JP2014/068441
§ 371 (c)(1),
(2) Date: Jan. 11, 2016

(87) PCT Pub. No.: WO2015/005432
PCT Pub. Date: Jan. 15, 2015

(65) Prior Publication Data

US 2016/0138203 A1 May 19, 2016

(30) Foreign Application Priority Data

Jul. 12, 2013 (JP) ..... 2013-146868

(51) Int. Cl.
*D04B 1/18* (2006.01)

(52) U.S. Cl.
CPC ..... *D04B 1/18* (2013.01)

(58) Field of Classification Search
CPC ..... D04B 1/18; D04B 1/102; D04B 1/104; D04B 1/20; D04B 9/26; D04B 9/34
See application file for complete search history.

(56) References Cited

U.S. PATENT DOCUMENTS 3,392,552 A * 7/1968 Muller ..... D04B 1/10 66/169 R
4,998,419 A 3/1991 Moore
(Continued)

FOREIGN PATENT DOCUMENTS

CN 102648313 A 8/2012
EP 1449 946 A1 8/2004
(Continued)

OTHER PUBLICATIONS

International Search Report dated Oct. 14, 2014, in corresponding International Application No. PCT/JP2014/068441; 2 pages.
(Continued)

*Primary Examiner* — Danny Worrell
(74) *Attorney, Agent, or Firm* — Finnegan, Henderson, Farabow, Garrett & Dunner, LLP

(57) ABSTRACT

Provided is an elastic circular knitted fabric which exhibits good wear comfort and excellent movement follow-up ability and can contribute to improvement in motor functions, which exhibits little tightness or a reduced shift during an action, which is not limited in application by stretching force, which is useful as a clothing material that is not susceptible to loosing shape due to wearing, and which has both excellent elongation and excellent elongation recovery of elongation. An elastic circular knitted fabric composed of an elastic fiber and a nonelastic fiber, wherein: knitted loops which contain the elastic fiber are continuously connected in the warp direction of the knitted fabric; the wales of the knitted loops are arranged in the weft direction of the knitted fabric in such a state that at least one wale of the knitted loops is present for every two wales; the aperture angle between the fiber bundles constituting the knitted loop of the nonelectric fiber is 50 to 150 degrees; the stretching forces of the elastic circular knitted fabric in the warp and weft directions at 80% elongation are 100 to 800 cN; the ratio of
(Continued)

the stretching force in the warp direction to that in the weft direction is 0.5 to 1.8; and the elongation recovery percentages of elongation in the warp and weft directions are 85% or more as determined after subjecting the fabric to three 80% elongation/recovery cycles.

11 Claims, 8 Drawing Sheets

(56) References Cited

U.S. PATENT DOCUMENTS

| | | | | |
|---|---|---|---|---|
| 5,687,587 | A * | 11/1997 | Michel | D04B 1/18 66/196 |
| 5,931,023 | A * | 8/1999 | Brach | D04B 1/18 66/125 R |
| 6,776,014 | B1 * | 8/2004 | Laycock | D04B 1/18 66/198 |
| 7,634,924 | B2 * | 12/2009 | Chuang | D04B 1/18 66/198 |
| 2004/0237599 | A1 * | 12/2004 | Kondou | D04B 1/18 66/202 |
| 2006/0010929 | A1 | 1/2006 | Chuang et al. | |
| 2012/0244773 | A1 | 9/2012 | Akita | |
| 2014/0238084 | A1 | 8/2014 | Yoshida et al. | |

FOREIGN PATENT DOCUMENTS

| | | |
|---|---|---|
| JP | 60-94654 | 5/1985 |
| JP | 2001-348762 | 12/2001 |
| JP | 2004-019059 | 1/2004 |
| JP | 2005-213662 | 8/2005 |
| TW | 201313978 | 4/2013 |
| WO | WO 03/038173 | 5/2003 |
| WO | WO-2011/070828 | 6/2011 |

OTHER PUBLICATIONS

International Preliminary Report on Patentability dated Jan. 12, 2016, in corresponding International Application No. PCT/JP2014/068441; 8 pages.

"Companion to Knitting Technology (weft knit)", 87, 88 (1980).

European search report from the European Patent of for counterpart European Application No. EP 14 82 3540 dated Jun. 1, 2016.

* cited by examiner

ELASTIC CIRCULAR KNITTED FABRIC

TECHNICAL FIELD

The present invention relates to an elastic circular knitted fabric having excellent extensibility and elongation recovery allowing its use in clothing such as sports wear and casual wear.

BACKGROUND ART

In the prior art, elastic circular knitted fabrics comprising elastic yarn are commonly used in clothing that fits directly onto the body, including shorts and inner wear such as girdles and brassieres, or undershirts and sports wear such as swimming wear, and a variety of such products are being marketed. Elastic circular knitted fabrics comprising elastic yarn are also widely used not only in body-fitting clothing but also in casual wear including T-shirts, parkas and bottoms. Circular knitted fabrics, because of their structure, generally stretch readily in the weft direction but only stretch very minimally in the warp direction compared to the weft direction, and have therefore been unsatisfactory in terms of compressed feeling and slipping during movement, when such are worn as products.

In addition, in such knitted fabrics that have different degrees of extensibility in the warp direction and weft direction, it is necessary to cut the fabric while matching the direction in which stress is to be applied when wearing the clothing, and the direction of easy stretching of the fabric, and this has placed a major restriction on the method of use of such fabrics.

Therefore, in order to achieve a suitable balance of extensibility in the both the warp and weft directions, for circular knitted fabrics with a double needle bed, there have been proposed circular knitted fabrics having warp elongation, by feeding a covering yarn or core yarn with elastic yarn as the core onto one needle bed, when knitting with each of the needles is independently carried out in each needle bed, but in such cases linkage of the elastic yarn in the warp direction, which governs the extensibility and recoverability in the warp direction, is intermittent, and as a result the movement-following property, resulting from the recoverability when the fabric is used in clothing, has been insufficient (see Patent Document 1 below).

In addition, there have been proposed circular knitted fabrics with excellent soft stretch properties in both the warp and weft directions, by using a specific copolymer elastic yarn and specifying the stitch length of the nonelastic fiber, but since the abrasion resistance is reduced with such specific copolymer elastic yarns, they have been poorly practical for clothing (see Patent Document 2 below).

In recent years, for clothing that closely fits the body, there has been a demand for clothing that not only expands and contracts to match movement of the body but also has a stretching function that supports movement of the body, and with clothing that does not fit directly onto the body, there has been a demand for clothing that reduces the stress produced when the clothing is worn, such as compressed feeling or clothing slippage, in the course of movement or routine operations. With the knitted fabrics of the prior art described above, however, it has been difficult to obtain clothing that stretches to the same extent in both the warp and weft directions and that has excellent elongation recovery, resulting in a satisfactory movement-following property and no disadvantages in terms of practical performance including abrasion resistance.

PRIOR ART DOCUMENTS

Patent Documents

Patent Document 1: Japanese Unexamined Patent Publication (Kokai) No. SHO60-94654

Patent Document 2: Japanese Unexamined Patent Publication (Kokai) No. 2005-213662

SUMMARY OF THE INVENTION

Problems to be Solved by the Invention

The problem to be solved by the present invention is the problem of the prior art described above, that is, to provide an elastic knitted fabric having excellent extensibility and recoverability, as well as an excellent movement-following property and feel during wear, that is suitable for clothing such as inner wear, sports wear, swimming wear, casual wear and the like.

Means for Solving the Problems

The present inventors have completed this invention as a result of diligent research directed toward solving the problem described above, and repeated experimentation that has included producing knitted fabrics with novel structures and conducting wearing tests.

Specifically, the present invention provides the following.

[1] An elastic circular knitted fabric composed of elastic fibers and nonelastic fibers, wherein knitted loops including elastic fibers are continuously connected in the warp direction of the knitted fabric, the rows of knitted loops are arranged in a proportion of at least 1 for every 2 rows in the weft direction of the knitted fabric, the aperture angle of the fiber bundles composing the knitted loops of the non-elastic fibers is 50 to 150 degrees, the stretching force in the warp direction and the stretching force in the weft direction at 80% elongation of the elastic circular knitted fabric are both 100 to 800 cN, the ratio of stretching force in the warp direction/stretching force in the weft direction is 0.5 to 1.8, and the elongation recovery factor in the warp direction and the elongation recovery factor in the weft direction are both 85% or greater, when 80% elongation and recovery have been repeated 3 times.

[2] An elastic circular knitted fabric according to [1] above, wherein the yarn length index of the nonelastic fibers per square inch of knitted fabric is 5000 to 15,000.

[3] An elastic circular knitted fabric according to [1] or [2] above, wherein the ratio of: density in the warp direction/density in the weft direction is 1.5 to 2.0.

[4] An elastic circular knitted fabric according to any one of [1] to [3] above, wherein the size (fineness) of the elastic fibers is 15 to 80 dtex.

[5] An elastic circular knitted fabric according to any one of [1] to [4] above, wherein the basis weight is 100 to 400 $g/m^2$.

[6] An elastic circular knitted fabric according to any one of [1] to [5] above, wherein the abrasion resistance is grade 3 or higher.

[7] An elastic circular knitted fabric according to any one of [1] to [6] above, wherein the knitted fabric is a single jersey texture, and the nonelastic fibers include at least two types.

[8] An elastic circular knitted fabric according to any one of [1] to [6] above, wherein the knitted fabric is an inlay texture, the nonelastic fibers that are inlay knitted on the back side of the knitted fabric are in a 1- to 3-over stitch, and at least one of the types of non-elastic fibers is crimped.

[9] An elastic circular knitted fabric according to any one of [1] to [6] above, wherein the knitted fabric is a moss stitch.

[10] An elastic circular knitted fabric according to any one of [1] to [6] above, wherein the knitted fabric is a honeycomb stitch.

[11] An elastic circular knitted fabric according to any one of [1] to [10], that includes cellulose fibers.

Effect of the Invention

When a fabric has stretched after movement in the stretching direction of the human body, stress in the stretching direction and stress of the fabric in the circumferential direction of the human body significantly affect the feel during wear, but since the elastic circular knitted fabric of the invention has a prescribed stretch degree in both the warp direction and weft direction of the knitted fabric, it exhibits excellent motility, movement-following properties and wearability, with excellent comfort when worn, and furthermore since unnecessary elongation of the fabric is prevented, it is possible to improve the durability of the fabric.

EMBODIMENTS FOR CARRYING OUT THE INVENTION

The present invention will now be explained in greater detail.

The elastic circular knitted fabric of the invention comprises elastic fibers and nonelastic fibers.

The nonelastic fibers used for this embodiment of the invention may be either filament yarn or spun yarn.

Specifically, as filament yarn there are preferred yarns composed of combined fibers including polyamide-based fibers, polyester-based fibers, acrylic fibers, polypropylene-based fibers, vinyl chloride-based fibers, cellulosic fibers and the like. The form of the filament yarn may be starting filaments (unprocessed yarn), false twisted yarn, colored yarn or the like, or it may be a composite of these. The cross-sectional shape of the filament yarn is not particularly restricted and may be round, triangular, cross-shaped, W-shaped, M-shaped, C-shaped, I-shaped, dogbone-shaped, hollow fiber-shaped or the like. As spun yarn, there are preferred natural fibers such as (tree) cotton, wool or hemp, or combined fibers with polyamide-based fibers, polyester-based fibers, acrylic fiber fibers, polypropylene-based fibers, vinyl chloride-based fibers, cellulosic fibers or the like, any of which may be used alone or as mixed spun fibers. In other words, the appropriate materials may be selected for use depending on the purpose.

As elastic fibers there may be used polyurethane elastic yarn, polyether/ester elastic yarn, polyamide elastic yarn, polyolefin elastic yarn, or such fibers in a covered state with nonelastic fibers. In addition, while there may also be used rubber yarn, which consists of filaments composed of natural rubber, synthetic rubber or semisynthetic rubber, polyurethane elastic yarn is most suitable as it has excellent stretchability and is generally in wide use. The polyurethane elastic yarn is polyurethane elastic yarn composed of a polyurethane produced by chain extension reaction of a prepolymer comprising a copolyether polyol of polytetramethylene glycol or tetrahydrofuran with a 3-alkyltetrahydrofuran, and diphenylmethane-4,4-diisocyanate, using ethylenediamine or 2-methyl-1,5-pentanediamine and ethylenediamine as a chain extender.

The elastic circular knitted fabric of this embodiment has knitted loops containing elastic fibers continuously connected in the warp direction of the knitted fabric, the rows of knitted loops containing the elastic fibers being arranged in a proportion of at least 1 for every 2 in the weft direction of the knitted fabric. That the knitted loops are connected in the warp direction means that the knitted loops are connected in the lengthwise direction of the knitted fabric.

Figure 1:
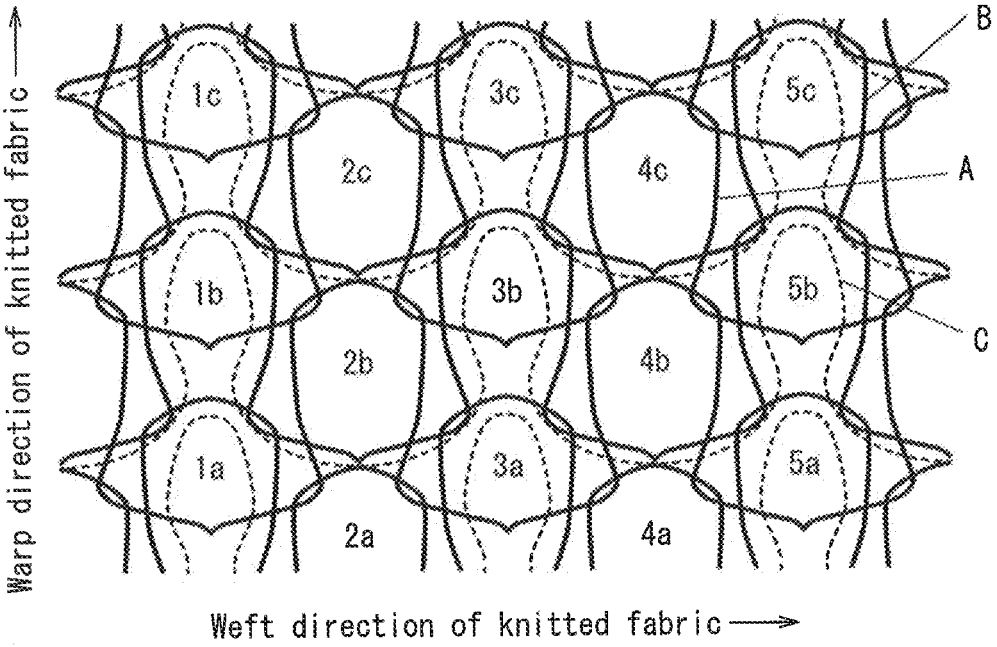
FIG. 1 is a block diagram of knitted loops according to the present embodiment.

Furthermore, as illustrated in detail in FIG. 1, that the knitted loops 1*a* to 1*c*, 3*a* to 3*c* and 5*a* to 5*c* containing elastic fiber, shown in FIG. 1, are connected in the warp direction, means that 1*a*, 1*b* and 1*c*, 3*a*, 3*b* and 3*c* and 5*a*, 5*b* and 5*c* are each connected.

Furthermore, that the knitted loop rows connected in the warp direction are arranged in a proportion of at least 1 for every 2 in the weft direction of the knitted fabric means that the rows of knitted loops connected in the warp direction are arranged in a proportion of 1 for every 2 in the widthwise direction of the knitted fabric. As a more detailed explanation based on FIG. 1, the rows of knitted loops including elastic fibers connected in the warp direction in FIG. 1, i.e. 1*a*, 1*b* and 1*c*, 3*a*, 3*b* and 3*c* and 5*a*, 5*b* and 5*c*, and the knitted loop rows not containing elastic fibers, i.e. 2*a*, 2*b* and 2*c* and 4*a*, 4*b* and 4*c*, are disposed in an alternating manner, with the rows of knitted loops including elastic fibers being disposed in a proportion of 1 for every 2. Having the knitted loops containing elastic fibers connected in the warp direction of the knitted fabric allows the stretchability of the elastic fibers to act in the warp direction of the circular knitted fabric, and improves elongation in the warp direction. However, if the knitted loop rows connected in the warp direction have a reduced proportion of elastic fibers, such as 1 to 3 or 1 to 4 (the number of rows of knitted loops of the nonelastic fiber alone increases), then the effect of the elastic fibers, of improving elongation in the warp direction of the circular knitted fabric, will be less prominent and it will be difficult to obtain a knitted fabric with satisfactory balance of elongation in the warp direction and weft direction. These structures consist of a knitted texture and elastic fiber yarn configuration, the knitted texture preferably being plain, inlay, smooth, fraise or the like, with no limitation to these, but the yarn configuration may even be modified so that the knitted loops containing elastic fibers are connected in the course direction, even if the texture is one such as moss stitch, honeycomb, mesh, confort or the like.

Figure 2:
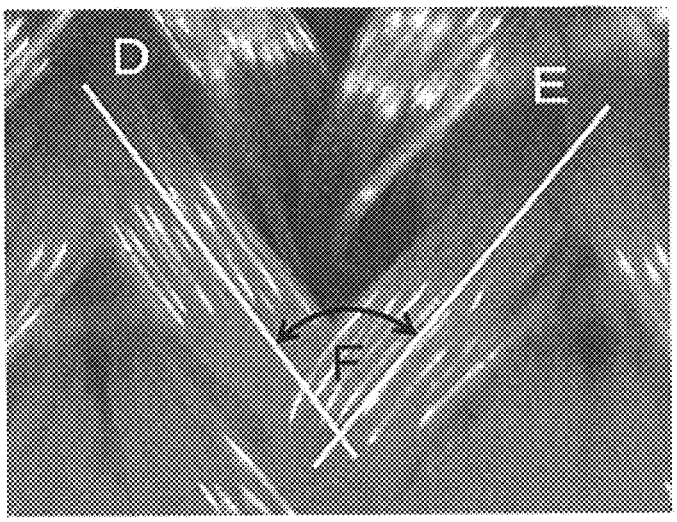
FIG. 2 is a diagram showing the aperture angle of fiber bundles forming the knitted loops of the present embodiment.

The elastic circular knitted fabric of this embodiment is characterized in that the aperture angles of the fiber bundles forming the non-elastic fiber knitted loops are in the range of 50 to 150 degrees. The angle is preferably 60 to 140 degrees, more preferably 70 to 130 degrees, even more preferably 80 to 120 degrees and most preferably 90 degrees to 110 degrees. If the aperture angles of the fiber bundles forming the nonelastic fiber knitted loops are less than 50 degrees or greater than 150 degrees, the balance of elongation in the warp direction and weft direction may be poor, and there may be poor mobility of movement when it is worn as clothing. The phrase "aperture angles of the fiber bundles forming the non-elastic fiber knitted loops", for the purpose of the invention, refers to the angle when a line (D) is drawn at the center of a fiber bundle forming a knitted loop at the top left and then a line (E) is similarly drawn at the center of a fiber bundle forming a knitted loop at the top right, in a magnified photograph taken of the knitted fabric surface, as shown in FIG. 2. The angle (F) formed between lines (D) and (E) is measured at a total of 10 different locations, and the average value is recorded.

When two or more different nonelastic fibers have been used, the aperture angle must be within a prescribed range for all of the nonelastic fibers.

The elastic circular knitted fabric of this embodiment has a stretching force of 100 cN to 800 cN in the warp direction and the weft direction at 80% elongation, and the stretching force ratio for warp direction/weft direction is 0.5 to 1.8.

The stretching force in the warp direction and weft direction is preferably 200 cN to 700 cN, more preferably 300 cN to 600 cN and even more preferably 400 cN to 500 cN. If the stretching force is less than 100 cN, the fitting feel will be inferior and the elongation recovery may be impaired. If the stretching force is greater than 800 cN, the excessive stretching force may result in a compressed feeling during movement. In addition, the stretching force ratio is preferably 0.6 to 1.7, more preferably 0.7 to 1.6, even more preferably 0.8 to 1.5 and most preferably 0.9 to 1.4. If the stretching force ratio in the warp direction/weft direction at 80% elongation is less than 0.5 or greater than 1.8, this is undesirable because the product may become deformed when worn, the fitting feel may be impaired, and a compressed feeling may become noticeable during movement. The "stretching force ratio in the warp direction/weft direction at 80% elongation of the knitted fabric", as defined according to the invention, will now be explained. A 25 mm-wide sample is anchored with a chucking with a grip spacing of 100 mm, and the maximum stress is measured while pulling to 80% of the grip spacing (to a grip spacing of 180 cm) at a pull rate of 300 mm/min. Two samples each were prepared for the warp direction and weft direction of the elastic knitted fabric, and using the respective average values for maximum stress as the stretching force, calculation was performed by the following formula (1):

$$\text{Stretching force ratio}=(\text{warp direction stretching force})/(\text{weft direction stretching force}) \quad (1)$$

The elastic knitted fabric of this embodiment has the feature of an elongation recovery factor of 85% or greater in both the warp direction and weft direction, after 80% elongation and recovery have been repeated 3 times. It is preferably 88% or greater and more preferably 90% or greater. If the elongation recovery factor in the warp direction and weft direction after 80% elongation and recovery have been repeated 3 times is less than 85%, the product may undergo deformation when worn. The phrase "elongation recovery factor in the warp direction and weft direction after 80% elongation and recovery have been repeated 3 times" will now be explained. After pulling to 80% of the grip spacing (to a grip spacing of 180 cm) with the same sample width, grip spacing and pull rate as for measurement of the stretching force, the grip spacing is restored to the original 100 mm at the same rate as the pull rate. Based on an elongation recovery curve obtained by repeating this 3 times, the residual strain (mm) after the third elongation recovery is read off, and calculation is performed by the following formula (2):

$$\text{Elongation recovery factor (\%)}=\{[(80\text{ mm}-(\text{residual strain}))/80\text{ mm}]\times 100 \quad (2)$$

For the elastic circular knitted fabric of this embodiment, the yarn length index of the nonelastic fibers per square inch of knitted fabric is preferably in the range of 5000 to 15,000, more preferably 7000 to 14,000, even more preferably 8000 to 13,000 and most preferably 9000 to 12,000. If the yarn length index of the nonelastic fibers per square inch of knitted fabric is less than 5000, the nonelastic fibers may become taut first, before the elastic fibers have adequately elongated, thereby inhibiting elongation of the elastic fibers and reducing the degree of elongation of the knitted fabric, and interfering with movement when it is worn as clothing. If the yarn length index of the nonelastic fiber per square inch of knitted fabric is greater than 15,000, the stretchability of the knitted fabric will be adequate, but the nonelastic fibers will be present in the knitted fabric in an unnecessarily relaxed state, the relaxation rising up to the knitted fabric surface and creating irregularities on the surface of the knitted fabric, which is undesirable as it may lead to problems such as pilling or snagging. The phrase "yarn length index of the non-elastic fibers per square inch of knitted fabric", as specified according to the invention, is that obtained by providing markings at 1-inch spacings in the weft direction of the knitted fabric, removing nonelastic fiber from the knitted fabric, suspending a load of 0.44 cN/dtex, measuring the length between markings, and recording the length of a 1-inch section of the knitted fabric. A space between markings is then cut out, the weight of the nonelastic fibers with the marked length is measured, and the weight per 10,000 m is calculated and recorded as the size. Next, the course number of the knitted fabric is measured with a densimeter or the like, and a value is obtained by the following formula (3):

$$\text{Yarn length index}=(\text{length of nonelastic fibers in 1-inch section of knitted fabric cm}\times\text{course number of knitted fabric})\times\sqrt{(\text{size})} \quad (3)$$

The nonelastic fibers whose lengths are measured here are nonelastic fibers forming the same knitted loops as the elastic fibers.

The elastic circular knitted fabric of this embodiment preferably has a ratio of density in the warp direction to density in the weft direction in the range of 1.5 to 2.5, more preferably 1.6 to 2.3, even more preferably 1.7 to 2.1 and most preferably 1.8 to 2.0. If the ratio of the density in the warp direction to the density in the weft direction is less than 1.5 or greater than 2.5, the balance of elongation in the warp direction and weft direction may be poor, and there may be poor mobility of movement when it is worn as clothing. The phrase "ratio of density in the warp direction to density in the weft direction", as specified according to the invention, is the value determined by measuring the density in the warp direction of the elastic circular knitted fabric (course number) and the density in the weft direction (wale number), as the number of courses and number wales in a 25.4 mm region as described in "Knitted fabric density" of JIS-L-1096, 8.6.2, as explained below, and performing calculation by the following formula (4):

$$\text{Density ratio}=(\text{density in warp direction:course number})/(\text{density in weft direction:wale number}) \quad (4)$$

The size of the elastic fibers used in the elastic circular knitted fabric of this embodiment is preferably in the range of 15 to 80 dtex, more preferably 20 to 60 dtex and even more preferably 30 to 50 dtex. If the size of the elastic fibers is less than 15 dtex, it may not be possible to obtain the necessary extensibility and recoverability. If it is greater than 80 dtex, the basis weight will be increased and the weight may be too great for wearing.

The elastic circular knitted fabric of this embodiment has a basis weight in the range of preferably 100 to 400 g/m$^2$, more preferably 130 to 350 g/m$^2$ and even more preferably 150 to 300 g/m$^2$. If the basis weight is less than 100 g/m$^2$, the masking property and rupture strength may be poor. If the basis weight exceeds 400 g/m$^2$, it may be too heavy when worn, inhibiting movement.

The elastic circular knitted fabric of this embodiment preferably has an abrasion resistance of grade 3 or higher, and more preferably grade 4 or higher. If the abrasion resistance is lower than grade 3, repeated wearing may result in multiple broken filaments in the yarn on the knitted fabric surface, an impaired pilling property, or tearing. The "abrasion resistance" as specified according to the invention is the value evaluated by Method C of the Abrasion resistance evaluation described in JIS-L-1076, 8.1.3.

The knitted texture used for this embodiment is preferably plain, inlay, smooth, fraise or the like, with no limitation to these, and it may be any knitted texture such as moss stitch, honeycomb, mesh, confort or the like, if the yarn configuration is modified so that the knitted loops containing elastic fibers are connected in the warp direction of the knitted fabric.

For a single jersey texture, it preferably comprises one type of elastic fiber and one type of nonelastic fiber, the arrangement being with a yarn length ratio preferably in the range of 1.80 to 3.20, more preferably 1.90 to 3.10 and even more preferably 2.00 to 3.00. The elastic fiber draft is in the range of preferably 2.5 to 3.5, more preferably 2.7 to 3.4 and even more preferably 2.8 to 3.3. The set amount of compressive shrinkage during presetting of the obtained greige is preferably 0 to 100%, more preferably 15 to 80%, even more preferably 25 to 60% and most preferably 35 to 50%. The presetting temperature is preferably 180 to 200° C., more preferably 185 to 195° C. and even more preferably 190 to 195° C. The tentering rate during presetting may be set as desired, but it is preferably −40 to +40%, more preferably −35 to +30% and even more preferably −30 to +20% of the greige width.

In order to add further performance to the knitted fabric, it may be a commonly known 3-layer plain knitted fabric comprising two types of non-elastic fibers and one type of elastic fiber. Since a 3-layer plain knitted fabric can employ one more type of non-elastic fiber than an ordinary plain knitted fabric, the properties of the additional non-elastic fiber can be added to the knitted fabric. The non-elastic fiber used in such cases may be any desired fiber having the properties to be imparted. For example, if it is desired to add a moisture absorption/desorption property to the knitted fabric, cellulose fibers may be used. In a 3-layer plain knitted fabric, the yarn lengths of the two types of non-elastic fibers may basically be the same, but the different yarn lengths may be varied by the shrinkage factors or crimp properties of the fibers used. The yarn lengths in such cases preferably differ within a range of ±10%. It is not preferred for the yarn length difference to be outside of this range because one of the yarns will be excessive, leading to irregularities on the surface. The elastic fiber draft is in the range of preferably 2.5 to 3.5, more preferably 2.7 to 3.4 and even more preferably 2.8 to 3.3. The presetting temperature, compressive shrinkage and tentering rate of the obtained greige may be the same as those of the single jersey texture described above. The non-elastic fiber used is preferably cellulose fiber with a moisture absorption/desorption property, to allow those properties to be imparted to the knitted fabric.

In an inlay texture, the nonelastic fibers to be inlay knitted on the back side of the knitted fabric have an arrangement in the range of preferably 1- to 3-over, and more preferably 1- to 2-over. If the non-elastic fibers to be inlay knitted on the back side of the knitted fabric are arranged without skipping, it may not be possible to obtain an irregular feel on the back side of the knitted fabric that is characteristic of an inlay texture, and elongation in the weft direction may become minimal. If the non-elastic fibers to be inlay knitted on the back side of the knitted fabric are 4-over or greater, then irregularities will be increased on the back side of the knitted fabric, leading to problems such as pilling and snagging, which are undesirable. In addition, since the nonelastic fibers to be inlay knitted on the back side of the knitted fabric directly affect elongation in the weft direction of the knitted fabric, it is preferred to use non-elastic fibers with crimping in order to improve the elongation in the weft direction. By using nonelastic fibers with crimping, the heat during dyeing will result in expression of the crimping, and the expressed stretchability will result in satisfactory elongation of the knitted fabric itself in the weft direction. Also, in order to improve elongation in the weft direction, the non-elastic fibers with crimping, that are to be inlay knitted on the back side of the knitted fabric, must be of at least one type, and preferably the yarn lengths of the non-elastic fibers to be inlay knitted on the back side of the knitted fabric are 40 to 70%, more preferably 43 to 65%, even more preferably 45 to 60% and most preferably 48 to 55%, of the yarn lengths of the nonelastic fibers forming the plain loops on the front side of the knitted fabric. If the yarn lengths of the nonelastic fibers to be inlay knitted on the back side of the knitted fabric are less than 40% of the yarn lengths of the nonelastic fibers forming the plain loops on the front side of the knitted fabric, then the yarn lengths of the non-elastic fibers used for inlay knitting will be shorter and the weft elongation will be reduced. If the yarn lengths of the non-elastic fibers to be inlay knitted on the back side of the knitted fabric are greater than 70% of the yarn lengths of the nonelastic fibers forming the plain loops on the front side of the knitted fabric, then the weft elongation will be adequate, but the non-elastic fibers will be present in the knitted fabric in an unnecessarily relaxed state, the relaxation rising up to the knitted fabric surface and creating irregularities on the surface of the knitted fabric, which is undesirable as it may lead to problems such as pilling or snagging.

The yarn length ratio of the elastic fibers and nonelastic fibers with the same knitted loops is preferably in the range of 1.80 to 3.20, more preferably 1.90 to 3.10 and even more preferably 2.00 to 3.00. The set amount of compressive shrinkage during presetting of the obtained greige is preferably 0 to 100%, more preferably 15 to 80%, even more preferably 25 to 60% and most preferably 35 to 50%. The presetting temperature is preferably 180 to 200° C., more preferably 185 to 195° C. and even more preferably 190 to 195° C. The tentering rate during presetting may be set as desired, but it is preferably −40 to +40%, more preferably −35 to +30% and even more preferably −30 to +20% of the greige width. Alternatively, it may be preferred for cellulose fiber with a moisture absorption/desorption property to be used in the nonelastic fibers that are to be inlay knitted, to allow those properties to be imparted to the knitted fabric.

While the yarns may be used as desired in a smooth texture, by arranging the elastic fibers in an alternating fashion it is possible to obtain a knitted fabric in which knitted loop rows containing elastic fibers and knitted loop rows not containing elastic fibers are alternately arranged in the warp direction of the knitted fabric. In this case, it is necessary to set separate yarn lengths for the non-elastic fibers forming the same knitted loops as elastic fiber and the nonelastic fibers forming knitted loops that do not contain elastic fiber. The non-elastic fibers forming the same knitted loops as elastic fiber have smaller knitted loops due to the effect of the elastic fiber, and a difference is created between the size of these knitted loops and the size of knitted loops of non-elastic fiber alone forming the knitted loops containing no elastic fiber, which can result in lifting of the knitted loops of non-elastic fiber alone on the surface, creating problems such as snagging. Thus, the yarn lengths for the non-elastic fibers forming the knitted loops containing no elastic fiber are preferably 5 to 20% shorter than the yarn lengths of the nonelastic fibers forming the same knitted loops as elastic fiber. The yarn length ratio of the elastic fibers and nonelastic fibers with the same knitted loops is preferably in the range of 1.80 to 3.20, more preferably 1.90 to 3.10 and even more preferably 2.00 to 3.00. The set amount of compressive shrinkage during presetting of the obtained greige is preferably 0 to 100%, more preferably 15 to 80%, even more preferably 25 to 60% and most preferably 35 to 50%. The presetting temperature is preferably 180 to 200° C., more preferably 185 to 195° C. and even more preferably 190 to 195° C. The tentering rate during presetting may be set as desired, but it is preferably −40 to +40%, more preferably −35 to +30% and even more preferably −30 to +20% of the greige width.

For a moss stitch, the yarn length ratio of elastic fibers and non-elastic fibers with the same knitted loops is preferably in the range of 1.80 to 3.20, more preferably 1.90 to 3.10 and even more preferably 2.00 to 3.00. For clarity of the moss stitch design, the set amount of compressive shrinkage during presetting is preferably −40 to 50%. It is more preferably −30 to 45% and even more preferably −20 to 40%. The presetting temperature is preferably 180 to 200° C., more preferably 185 to 195° C. and even more preferably 190 to 195° C. The tentering rate during presetting may be set as desired, but it is preferably −40 to +40%, more preferably −35 to +30% and even more preferably −30 to +20% of the greige width. The type of yarn may be selected as desired, but it is preferred to use cellulose fiber with a moisture absorption/desorption property, to allow those properties to be imparted to the knitted fabric.

For a honeycomb stitch, the yarn length ratio of elastic fibers and nonelastic fibers with the same knitted loops is preferably in the range of 1.80 to 3.20, more preferably 1.90 to 3.10 and even more preferably 2.00 to 3.00. The set amount of compressive shrinkage during presetting of the obtained greige is preferably 0 to 100%, more preferably 15 to 80%, even more preferably 25 to 60% and most preferably 35 to 50%. The presetting temperature is preferably 180 to 200° C., more preferably 185 to 195° C. and even more preferably 190 to 195° C. The tentering rate during presetting may be set as desired, but it is preferably −40 to +40%, more preferably −35 to +30% and even more preferably −30 to +20% of the greige width. Alternatively, it may be preferred for cellulose fiber with a moisture absorption/desorption property to be used in some of the non-elastic fibers, to allow those properties to be imparted to the knitted fabric.

The elastic circular knitted fabric of this embodiment preferably includes cellulose fibers. The cellulose fibers, when in the form of filament yarn, may be starting filaments (unprocessed yarn), false twisted yarn, colored yarn or the like, or they may be a composite yarn with polyester-based fibers or polyamide-based fibers. They may also be spun yarn, or blended yarn with polyester-based fibers or polyamide-based fibers. Cellulose fibers are preferably cupra fibers. The size of the cellulose fibers used, in the case of filament yarn, is preferably 30 to 200 dtex, more preferably 40 to 170 dtex and even more preferably 50 to 120 dtex. Alternatively, in the case of spun yarn, it is preferably #60 to #30 and more preferably #50 to #40 spun yarn.

The elastic circular knitted fabric of this embodiment has a yarn length ratio between elastic fibers and nonelastic fibers forming the same knitted loops, preferably in the range of 1.80 to 3.20, more preferably 1.90 to 3.10 and even more preferably 2.00 to 3.00. When elastic fibers and nonelastic fibers form the same knitted loops, for ease of elongation of the knitted fabric it is necessary for the yarn lengths of the nonelastic fibers to be greater than the yarn lengths of the elastic fibers. If the yarn lengths of the elastic fibers and non-elastic fibers are less than 1.80, the nonelastic fibers may become taut first, before the elastic fibers have adequately elongated, inhibiting elongation of the elastic fibers and reducing the degree of elongation of the knitted fabric, and interfering with movement when it is worn as clothing. If the yarn lengths of the elastic fibers and non-elastic fibers are greater than 3.20, the stretchability of the knitted fabric will be adequate, but the non-elastic fibers will be present in the knitted fabric in an unnecessarily relaxed state, the relaxation rising up to the knitted fabric surface and creating irregularities on the surface of the knitted fabric, which is undesirable as it may lead to problems such as pilling or snagging. The term "yarn length ratio of the elastic fibers and non-elastic fibers", as specified according to the invention, is the value determined by removing elastic fibers and nonelastic fibers in a 100 wale portion from the knitted fabric, suspending a load of 0.01 cN/dtex from the elastic fibers and 0.44 cN/dtex from the nonelastic fibers and measuring their lengths, and performing calculation by the following formula (5):

$$\text{Yarn length ratio} = (\text{yarn length of nonelastic fibers})/(\text{yarn length of elastic fibers}) \quad (5)$$

The size of the non-elastic fibers, as filament yarn, is preferably 30 to 200 dtex, more preferably 40 to 170 dtex and even more preferably 50 dtex to 120 dtex, so that the clothing does not become too heavy when worn. Alternatively, for spun yarn, it is preferably #60 to #30 and more preferably #50 to #40.

The monofilament size of the nonelastic fiber is preferably 0.3 to 3.0 dtex, more preferably 0.5 to 25 dtex and even more preferably 0.8 to 2.3 dtex, in order to avoid inhibiting the stretchability of the elastic fiber and to obtain clothing with a soft feel.

The elastic circular knitted fabric of this embodiment has an elastic fiber draft in the range of preferably 2.5 to 3.5, more preferably 2.8 to 3.4 and even more preferably 3.0 to 3.3.

The deformation and fitting feel during actual wear significantly affects the elongation recovery factor of the fabric used for the wear, but during actual movement, it is important for the fabric to follow movement, and therefore instantaneous recoverability is particularly important. The present inventors have therefore carried out diligent research to create an index for evaluating instantaneous recoverability.

Figure 3:
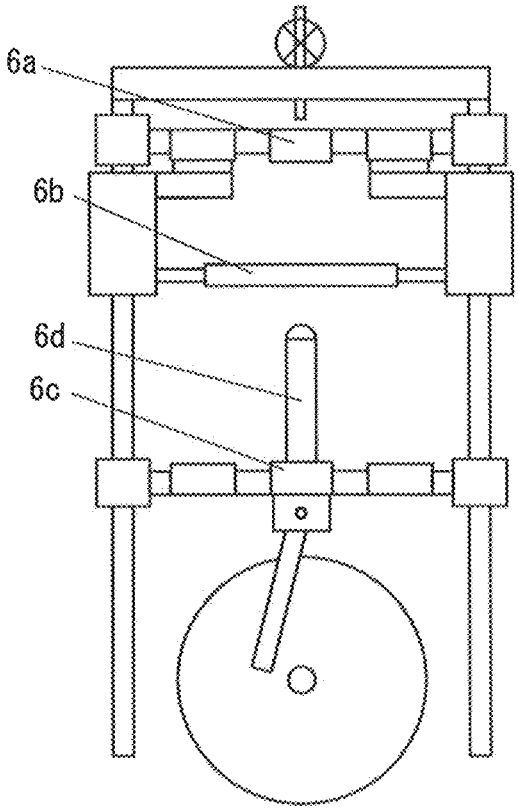
FIG. 3 shows an apparatus for evaluation of the instantaneous recoverability of an elastic circular knitted fabric according to the present embodiment.

A schematic diagram of the tester used is shown in FIG. 3. Specifically, a DeMattia fatigue testing machine (Model DC-3) by Daiei Kagaku Seiki Manufacturing Co., Ltd. was used, with a 20 cm-square sample on the fixed sample holder 1*a* of the tester, fixing it onto the sample-fixing frame 1*b* of the tester and setting it in the tester. Also, a thrusting rod 1*d* was set on a movable sample holder 1*c* in the same tester. The maximum thrusting height of the thrusting rod 1*d* was adjusted for a thrusting rod height of 6 cm above the sample-fixing frame 1*b*. The maximum thrusting height of the thrusting rod was set for about 50% stretching of the sample at maximum thrust. A "HIMAWARI GE200" high-speed camera by Library Co., Ltd. was set at the horizontal position of the sample-fixing frame with a tripod, and at a position 20 cm from the front surface of the sample-fixing frame. The DeMattia fatigue testing machine was set for 500 thrusting actions per minute and operated, and the 500th thrusting action was imaged under conditions of 200 frames/sec. Based on the moving image, with the point where the tip of the rod passed the bottom end of the sample-fixing frame defined as "0", during lowering of the rod after 500 thrusting actions, the maximum sagging of the sample from the sample-fixing frame within 0.05 second from that point was measured using "Move-tr/2D" action analysis software by Library Co. Ltd. Lower sample sagging at this time equates to more excellent instantaneous recoverability and a more satisfactory shape-following property during movement, and the maximum sample sagging after 500 thrusts is preferably no greater than 3.0 mm, more preferably no greater than 2.5 mm and even more preferably no greater than 2.0 mm. For satisfactory instantaneous recoverability, a knitted fabric as described in the present application is necessary.

The elastic circular knitted fabric of this embodiment is not particularly restricted so long as it can be formed using a flat knitting machine, single circular knitting machine or double circular knitting machine, and the target basis weight and texture feel can be obtained.

There are also no particular restrictions on the gauge of the knitting machine, but it is preferred to select a 18 to 40 gauge knitting machine, as desired according to the purpose of use and the thickness of the fibers used. It is more preferably 22 to 32 gauge and even more preferably 24 to 28 gauge.

After the elastic circular knitted fabric of this embodiment has been formed into a greige, it must be preset and subjected to dyeing steps of dyeing and final setting. The processing method may be carried out according to a common processing method for elastic fiber-mixed circular knitted fabrics, but to achieve the required elongation properties and desired elongation balance, preferably the temperature during presetting, the tentering rate, and the compressive shrinkage factor in the warp direction are adjusted. In order to obtain a satisfactory balance between elongation in the warp direction and weft direction in an elastic circular knitted fabric according to this embodiment it is necessary to improve the elongation in the warp direction of the circular knitted fabric, and for this purpose it is insufficient to merely set the yarn length of the nonelastic fiber during creation of the greige, it being important to also set the compressive shrinkage in the warp direction during presetting in the dyeing step. Compressive shrinkage is feeding in the knitted fabric to increase the density in the warp direction of the knitted fabric, and it is also known as thrusting. The set amount of compressive shrinkage is preferably −20 to 100%, more preferably −10 to 80%, even more preferably −5 to 60% and most preferably 0 to 50%. In other words, it is necessary to increase the elongation in the warp direction by increasing the density in the warp direction of the knitted fabric.

The presetting temperature, is preferably 180 to 200° C., more preferably 185 to 195° C. and even more preferably 190 to 195° C. At below 180° C. the setting may not be sufficiently effective, and it may not be possible to control the dimensional stability or density. If it is higher than 200° C., the polyurethane fiber strength and elastic modulus will tend to be lower, and the knitted fabric may have an inferior elongation percentage or recovery factor.

The tentering rate during presetting may be set as desired, but it is preferably −40 to +40%, more preferably −35 to +30% and even more preferably −30 to +20% of the greige width. If it is below −40% with respect to the greige width, the fabric may sag too much inside the setter, and fouling or pressed discoloration may be produced by contact with the setter wall faces. If it is above +40% with respect to the greige width, elongation in the weft direction may be excessively low, and the balance with elongation in the warp direction may be poor.

In addition, as an accessory step in the dyeing stage there may be carried out soil release processing, antimicrobial processing, deodorant processing, anti-odor processing, perspiration absorption processing, moisture absorption processing, ultraviolet absorption processing, weight-reduction processing or the like, or as post-processing there may be carried out calendering, embossing, wrinkling, piling, opal finishing, flexibilizing using a silicon-based flexibilizer or the like, which may be added as appropriate depending on the final required properties.

The elastic circular knitted fabric of this embodiment can be obtained with modifications to the aforementioned yarn usage, knitted texture, arrangement conditions and the like, and a combination of the aforementioned presetting conditions.

The elastic circular knitted fabric of this embodiment can be used for purposes such as inner wear, sports wear, swimming wear and the like that fit onto the body, and by using the elastic circular knitted fabric of this embodiment, a satisfactory feel during wear is exhibited, while it is also possible to obtain an excellent movement-following property and contribute to improved motor function, and to allow production of clothing that is resistant to deformation when it is worn, without being limited in use by its stretching force, and having an excellent appearance and feel during wear. In addition, when long tights and a long-sleeved shirt were prepared from elastic circular knitted fabrics of this embodiment, and bending and stretching of the knees was conducted with the long tights worn while bending and stretching of the elbow was conducted while the long-sleeved shirt was worn, the results indicated that for bending and stretching under a low load, a short recovery time was exhibited for the amount of deoxygenated hemoglobin in the rectus femoris muscular tissue or in the brachial biceps muscular tissue, compared to when they were not worn. Hemoglobin that has carried oxygen from the lungs (oxygenated hemoglobin) supplies oxygen to muscular tissue, especially during aerobic exercise, while deoxygenated hemoglobin is hemoglobin without oxygen, and if the time after the level of deoxygenated hemoglobin has increased by exercise until it is restored to the level before exercise is more rapid, the recovery effect is increased by that extent. This effect is believed to result from 1.5 the stretch properties and instantaneous recoverability of the elastic circular knitted fabric of this embodiment, which produces accelerated venous return and improved blood flow.

EXAMPLES

The present invention will now be explained in greater detail by examples.

Evaluation in the examples was conducted in the following manner, in addition to the different measured values mentioned above.

[Deformation Property During Wear]

A tennis shirt fitting on the body was sewed using the elastic knitted fabric produced in the example, and after 2 hours of playing tennis, it was removed and a visual judgment was made based on the following evaluation criteria, including also the presence or absence of deformation of the knitted fabric, particularly at the elbows, and for shirts where the knitted fabric at the elbow section had deformed, whether or not the deformation disappeared when rubbed with the hand after removal. There were considered to be no practical problems if the evaluation was 3 or greater on the following scale.

5: Absolutely no deformation

4: Slight deformation at elbow section but not of concern

3: Deformation at elbow section but deformation disappeared upon rubbing

2: Significant deformation at elbow section which could not be restored except by vigorous rubbing 1: Extreme deformation at elbow section which could not be restored even with vigorous rubbing

Example 1

Figure 4:
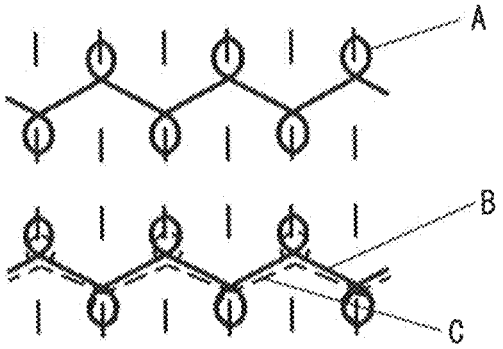
FIG. 4 shows an example of a weave diagram for an elastic circular knitted fabric according to the present embodiment.

Using a 28 gauge double circular knitting machine, and using, as the elastic fibers, 33 dtex polyurethane elastic fibers composed of a prepolymer using polytetramethylene glycol, and as the nonelastic fibers, 56 dtex/72 f polyester filaments and 84 dtex/72 f polyester filaments, a greige was produced with a knitted texture as shown in FIG. 4, the non-elastic fiber yarn length being 260 nm/100 W for 56 dtex/72 f and 310 mm/100 W for 84 dtex/72 f, and 150 mm/100 W for the elastic fibers, for a yarn length ratio of 2.07. The greige had knitted loops containing elastic fibers connected in the warp direction of the knitted fabric, the rows of knitted loops containing the connected elastic fibers being arranged in a proportion of 1 for every 2 in the weft direction of the knitted fabric. After passing the greige through a hot water layer at 80° C., presetting was performed under conditions of 195° C.×60 seconds, with setting of the tentering rate at −30% with respect to the greige width and the compressive shrinkage factor in the warp direction at +38% with respect to the course density of the greige, and processing was carried out with the subsequent dyeing conditions and finishing conditions as ordinary conditions for an elastic circular knitted fabric, to obtain a fabric. That is, upon dyeing at 130° C. and finish setting at 140° C., there was obtained a knitted fabric having a basis weight of 190 g/m$^2$, a course number of 72, a wale number of 40, a course number/wale number ratio of 1.80, a knitted loop aperture angle of 100 degrees for 56 dtex/72 f and 112 degrees for 84 dtex/72 f, for the non-elastic fibers, and a yarn length index of 8024 for the non-elastic fibers. The stretching force of the obtained knitted fabric was 261 cN in the warp direction and 273 cN in the weft direction, for a stretching force ratio of 0.95, the elongation recovery factor was 90% in the warp direction and 90% in the weft direction, the sample sagging in the instantaneous recoverability evaluation was 1.7 mm, and the abrasion resistance was grade 4. The obtained circular knitted fabric was a knitted fabric with excellent warp and weft stretch balance and elongation recovery, a satisfactory movement-following property, no compressed feeling when worn, and low wearing deformation.

Example 2

Figure 5:
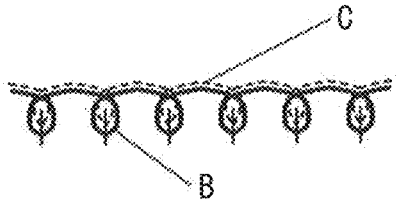
FIG. 5 shows an example of a weave diagram for an elastic circular knitted fabric according to the present embodiment.

Using a 24 gauge single circular knitting machine, and using, as the elastic fibers, 44 dtex polyurethane elastic fibers composed of a prepolymer using polytetramethylene glycol, and as the nonelastic fibers, #43 polyester spun yarn, a greige was produced with a knitted texture as shown in FIG. 5, having a yarn length of 300 mm/100 W for the non-elastic fibers and 100 mm/100 W for the elastic fibers, for a yarn length ratio of 3.00. The greige had knitted loops containing elastic fibers connected in the warp direction of the knitted fabric, the rows of knitted loops containing the connected elastic fibers being arranged on all of the rows in the weft direction of the knitted fabric. After passing the greige through a hot water layer at 80° C., presetting was performed under conditions of 195° C.×60 seconds, with setting of the tentering rate at 0% with respect to the greige width and the compressive shrinkage factor in the warp direction at 0% with respect to the course density of the greige, and dyeing and finishing processing were carried out in the same manner as Example 1 to obtain a fabric. The obtained fabric had a basis weight of 257 g/m$^2$, a course number of 82, a wale number of 46, a course number/wale number ratio of 1.78, a knitted loop aperture angle of 90 degrees for the non-elastic fibers, and a yarn length index of 12586 for the non-elastic fibers. The stretching force of the obtained knitted fabric was 666 cN in the warp direction and 467 cN in the weft direction, for a stretching force ratio of 1.43, the elongation recovery factor was 91% in the warp direction and 90% in the weft direction, the sample sagging in the instantaneous recoverability evaluation was 1.5 mm, and the abrasion resistance was grade 4. The obtained circular knitted fabric was a knitted fabric with excellent warp and weft stretch balance and elongation recovery, a satisfactory movement-following property, no compressed feeling when worn, and low wearing deformation.

Example 3

Using a 28 gauge single circular knitting machine, and using, as the elastic fibers, 22 dtex polyurethane elastic fibers composed of a prepolymer using polytetramethylene glycol, and as the non-elastic fibers, #40 polyester spun yarn, a greige was produced with a knitted texture as shown in FIG. 5, having a yarn length of 290 mm/100 W for the non-elastic fibers and 96 mm/100 W for the elastic fibers, for a yarn length ratio of 3.02. The greige had knitted loops containing elastic fibers connected in the warp direction of the knitted fabric, the rows of knitted loops containing the connected elastic fibers being arranged on all of the rows in the weft direction of the knitted fabric. After passing the greige through a hot water layer at 80'C, presetting was performed under conditions of 198° C.×60 seconds, with setting of the tentering rate at +3% with respect to the greige width and the compressive shrinkage factor in the warp direction at +20% with respect to the course density of the greige, and dyeing and finishing processing were carried out in the same manner as Example 1 to obtain a fabric. The obtained fabric had a basis weight of 165 g/m$^2$, a course number of 60, a wale number of 41, a course number/wale number ratio of 1.46, a knitted loop aperture angle of 52 degrees for the non-elastic fibers, and a yarn length index of 7221 for the non-elastic fibers. The stretching force of the obtained knitted fabric was 518 cN in the warp direction and 290 cN in the weft direction, for a stretching force ratio of 1.79, the elongation recovery factor was 87% in the warp direction and 86% in the weft direction, the sample sagging in the instantaneous recoverability evaluation was 2.4 mm, and the abrasion resistance was grade 4. The obtained circular knitted fabric was a knitted fabric with somewhat excellent warp and weft stretch balance and elongation recovery, a somewhat satisfactory movement-following property and low compressed feeling when worn, but low wearing deformation.

Example 4

Using a 24 gauge single circular knitting machine, and using, as the elastic fibers, 44 dtex polyurethane elastic fibers composed of a prepolymer using polytetramethylene glycol, and as the nonelastic fibers, #43 polyester spun yarn, a greige was produced with a knitted texture as shown in FIG. 5, having a yarn length of 250 mm/100 W for the non-elastic fibers and 84 mm/100 W for the elastic fibers, for a yarn length ratio of 2.98. The greige had knitted loops containing elastic fibers connected in the warp direction of the knitted fabric, the rows of knitted loops containing the connected elastic fibers being arranged on all of the rows in the weft direction of the knitted fabric. After passing the greige through a hot water layer at 80° C., presetting was performed under conditions of 195° C.×60 seconds, with setting of the tentering rate at +30% with respect to the greige width and the compressive shrinkage factor in the warp direction at −15% with respect to the course density of the greige, and dyeing and finishing processing were carried out in the same manner as Example 1 to obtain a fabric. The obtained fabric had a basis weight of 127 g/m$^2$, a course number of 51, a wale number of 35, a course number/wale number ratio of 1.46, a knitted loop aperture angle of 53 degrees for the non-elastic fibers, and a yarn length index of 4931 for the non-elastic fibers. The stretching force of the obtained knitted fabric was 766 cN in the warp direction and 607 cN in the weft direction, for a stretching force ratio of 1.26, the elongation recovery factor was 85% in the warp direction and 86% in the weft direction, the sample sagging in the instantaneous recoverability evaluation was 0.9 mm, and the abrasion resistance was grade 4. The obtained circular knitted fabric was a knitted fabric with somewhat excellent warp and weft stretch balance and elongation recovery, a satisfactory movement-following property and low compressed feeling when worn, but low wearing deformation.

Example 5

Using a 24 gauge single circular knitting machine, and using, as the elastic fibers, 44 dtex polyurethane elastic fibers composed of a prepolymer using a copolyether polyol of tetrahydrofuran and a 3-alkyltetrahydrofuran, and as the non-elastic fibers, #43 polyester spun yarn, a greige was produced with a knitted texture as shown in FIG. 5, having a yarn length of 300 mm/100 W for the non-elastic fibers and 100 mm/100 W for the elastic fibers, for a yarn length ratio of 3.00. The greige had knitted loops containing elastic fibers connected in the warp direction of the knitted fabric, the rows of knitted loops containing the connected elastic fibers being arranged on all of the rows in the weft direction of the knitted fabric. After passing the greige through a hot water layer at 80° C., presetting was performed under conditions of 185° C.×60 seconds, with setting of the tentering rate at +7% with respect to the greige width and the compressive shrinkage factor in the warp direction at +4% with respect to the course density of the greige, and dyeing and finishing processing were carried out in the same manner as Example 1 to obtain a fabric. The obtained fabric had a basis weight of 185 g/m$^2$, a course number of 85, a wale number of 48, a course number/wale number ratio of 1.77, a knitted loop aperture angle of 92 degrees for the non-elastic fibers, and a yarn length index of 13613 for the non-elastic fibers. The stretching force of the obtained knitted fabric was 576 cN in the warp direction and 389 cN in the weft direction, for a stretching force ratio of 1.48, the elongation recovery factor was 89% in the warp direction and 91% in the weft direction, the sample sagging in the instantaneous recoverability evaluation was 2.7 mm, and the abrasion resistance was grade 2.5. The obtained circular knitted fabric was a knitted fabric with somewhat excellent warp and weft stretch balance and elongation recovery, a somewhat satisfactory movement-following property and low compressed feeling when worn, but low wearing deformation.

Example 6

Using a 24 gauge single circular knitting machine, and using, as the elastic fibers, 22 dtex polyurethane elastic fibers composed of a prepolymer using polytetramethylene glycol, and as the nonelastic fibers, #43 polyester spun yarn and 84 dtex/54 f cupra fiber, a greige was produced with a knitted texture as shown in FIG. 5, having a nonelastic fiber yarn length of 340 mm/100 W for the polyester spun yarn and 320 mm/100 W for the cupra fiber, and 108 mm/100 W for the elastic fibers, for a yarn length ratio of 2.96. The greige had knitted loops containing elastic fibers continuously connected in the warp direction of the knitted fabric, the rows of knitted loops containing the connected elastic fibers being arranged on all of the rows in the weft direction of the knitted fabric. After passing the greige through a hot water layer at 80° C., presetting was performed under conditions of 198° C.×60 seconds, with setting of the tentering rate at −4% with respect to the greige width and the compressive shrinkage factor in the warp direction at +40% with respect to the course density of the greige, and dyeing and finishing processing were carried out in the same manner as Example 1 to obtain a fabric. The obtained fabric had a basis weight of 272 g/m$^2$, a course number of 65, a wale number of 36, a course number/wale number ratio of 1.81, a knitted loop aperture angle of 118 degrees for the non-elastic fibers, and a yarn length index of 8954 for the non-elastic fibers. The stretching force of the obtained knitted fabric was 621 cN in the warp direction and 384 cN in the weft direction, for a stretching force ratio of 1.62, the elongation recovery factor was 90% in the warp direction and 90% in the weft direction, the sample sagging in the instantaneous recoverability evaluation was 1.9 mm, and the abrasion resistance was grade 4. The obtained circular knitted fabric was a knitted fabric with excellent warp and weft stretch balance and elongation recovery, a satisfactory movement-following property, minimal compressed feeling when worn, and low wearing deformation.

Example 7

Figure 6:
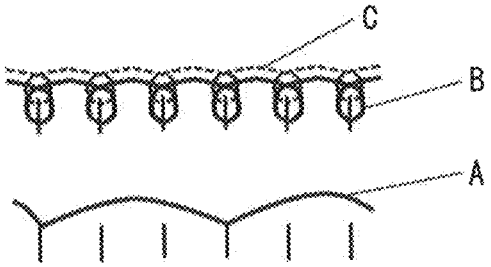
FIG. 6 shows an example of a weave diagram for an elastic circular knitted fabric according to the present embodiment.

Using a 24 gauge single circular knitting machine, and using, as the elastic fibers, 44 dtex polyurethane elastic fibers composed of a prepolymer using polytetramethylene glycol, and as the nonelastic fibers, #43 polyester spun yarn and 84 dtex/36 f polyester filaments, a greige was produced with a knitted texture as shown in FIG. 6, having a non-elastic fiber yarn length of 312 mm/100 W for the polyester spun yarn and 140 mm/100 W for the polyester filaments, and 106 nm/100 W for the elastic fibers, for a yarn length ratio of 2.94. The greige had knitted loops containing elastic fibers continuously connected in the warp direction of the knitted fabric, the rows of knitted loops containing the connected elastic fibers being arranged on all of the rows in the weft direction of the knitted fabric. After passing the greige through a hot water layer at 80'C, presetting was performed under conditions of 198° C.×60 seconds, with setting of the tentering rate at −10% with respect to the greige width and the compressive shrinkage factor in the warp direction at +25% with respect to the course density of the greige, and dyeing and finishing processing were carried out in the same manner as Example 1 to obtain a fabric. The obtained fabric had a basis weight of 255 g/m$^2$, a course number of 69, a wale number of 42, a course number/wale number ratio of 1.64, a knitted loop aperture angle of 81 degrees for the nonelastic fibers, and a yarn length index of 8979 for the nonelastic fibers. The stretching force of the obtained knitted fabric was 390 cN in the warp direction and 422 cN in the weft direction, for a stretching force ratio of 0.92, the elongation recovery factor was 92% in the warp direction and 90% in the weft direction, the sample sagging in the instantaneous recoverability evaluation was 1.4 mm, and the abrasion resistance was grade 4. The obtained circular knitted fabric was a knitted fabric with excellent warp and weft stretch balance and elongation recovery, a satisfactory movement-following property, minimal compressed feeling when worn, and low wearing deformation.

Example 8

Figure 7:
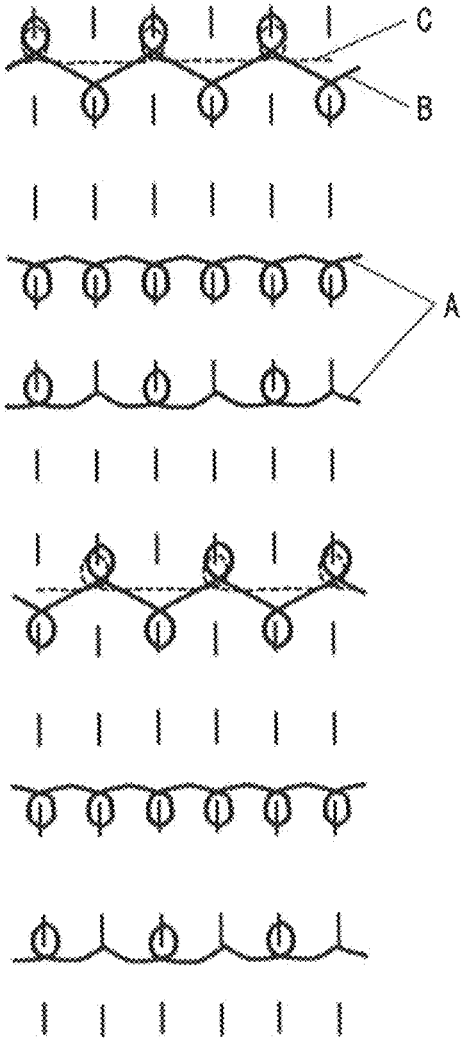
FIG. 7 shows an example of a weave diagram for an elastic circular knitted fabric according to the present embodiment.

Using a 28 gauge double circular knitting machine, and using, as the elastic fibers, 33 dtex polyurethane elastic fibers composed of a prepolymer using polytetramethylene glycol, and as the non-elastic fibers, 56 dtex/24 f polyester filaments and 110 dtex/36 f polyester filaments, a greige was produced with a knitted texture as shown in FIG. 7, the nonelastic fiber yarn length being 256 mm/100 W for both 56 dtex/24 f and 110 dtex/36 f, and 112 mm/100 W for the elastic fibers, for a yarn length ratio of 2.29. The greige had knitted loops containing elastic fibers continuously connected in the warp direction of the knitted fabric, the rows of knitted loops containing the connected elastic fibers being arranged in a proportion of 1 for every 2 in the weft direction of the knitted fabric. After passing the greige through a hot water layer at 80° C., presetting was performed under conditions of 198° C.×60 seconds, with setting of the tentering rate at +10% with respect to the greige width and the compressive shrinkage factor in the warp direction at +40% with respect to the course density of the greige, and dyeing and finishing processing were carried out in the same manner as Example 1 to obtain a fabric. The obtained fabric had a basis weight of 195 g/m$^2$, a course number of 57, a wale number of 35, a course number/wale number ratio of 1.63, a knitted loop aperture angle of 79 degrees for the non-elastic fibers, and a yarn length index of 5615 for the non-elastic fibers. The stretching force of the obtained knitted fabric was 856 cN in the warp direction and 509 cN in the weft direction, for a stretching force ratio of 1.68, the elongation recovery factor was 90% in the warp direction and 91% in the weft direction, the sample sagging in the instantaneous recoverability evaluation was 2.0 mm, and the abrasion resistance was grade 4. The obtained circular knitted fabric was a knitted fabric with excellent warp and weft stretch balance and elongation recovery, a satisfactory movement-following property, minimal compressed feeling when worn, and low wearing deformation.

Example 9

Figure 8:
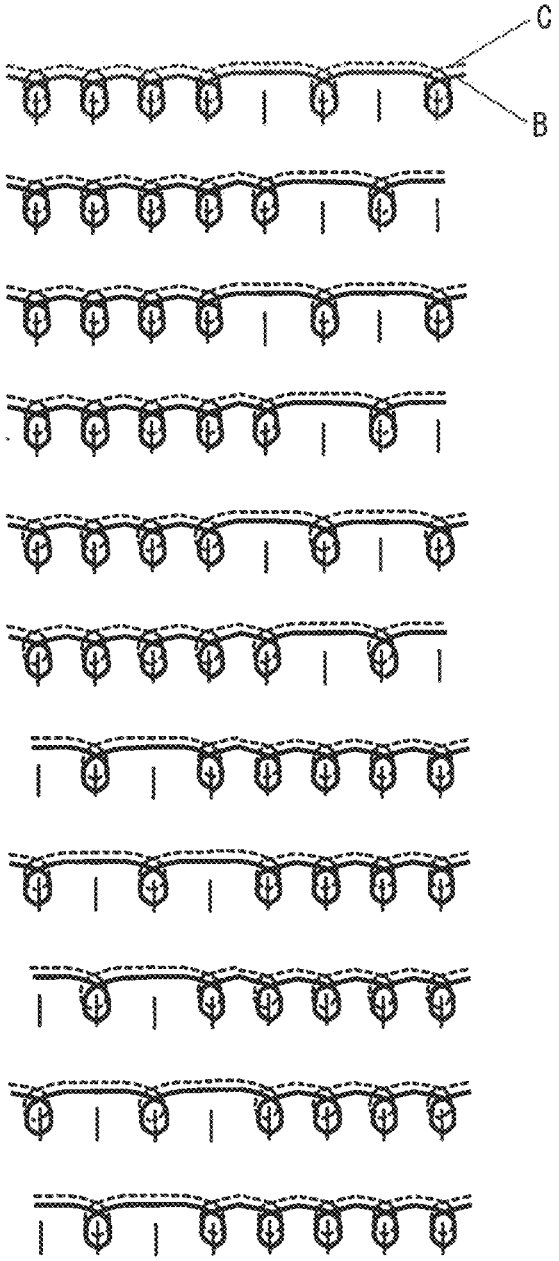
FIG. 8 shows an example of a weave diagram for an elastic circular knitted fabric according to the present embodiment.

Using a 28 gauge single circular knitting machine, and using, as the elastic fibers, 22 dtex polyurethane elastic fibers composed of a prepolymer using polytetramethylene glycol, and as the non-elastic fibers, 84 dtex/72 f polyester filaments and 84 dtex/54 f cupra fiber, a greige was produced with a knitted texture as shown in FIG. 8, having a non-elastic fiber yarn length of 200 mm/100 W for both the polyester filaments and cupra fibers, and 67 mm/100 W for the elastic fibers, for a yarn length ratio of 2.99. The greige had knitted loops containing elastic fibers continuously connected in the warp direction of the knitted fabric, the rows of knitted loops containing the connected elastic fibers being arranged on all of the rows in the weft direction of the knitted fabric. After passing the greige through a hot water layer at 80° C., presetting was performed under conditions of 195° C.×60 seconds, with setting of the tentering rate at +3% with respect to the greige width and the compressive shrinkage factor in the warp direction at +20% with respect to the course density of the greige, and dyeing and finishing processing were carried out in the same manner as Example 1 to obtain a fabric. The obtained fabric had a basis weight of 160 g/m$^2$, a course number of 133, a wale number of 60, a course number/wale number ratio of 2.22, a knitted loop aperture angle of 126 degrees for the non-elastic fibers, and a yarn length index of 13652 for the non-elastic fibers. The stretching force of the obtained knitted fabric was 655 cN in the warp direction and 423 cN in the weft direction, for a stretching force ratio of 1.55, the elongation recovery factor was 91% in the warp direction and 90% in the weft direction, the sample sagging in the instantaneous recoverability evaluation was 1.9 mm, and the abrasion resistance was grade 4. The obtained circular knitted fabric was a knitted fabric with excellent warp and weft stretch balance and elongation recovery, a satisfactory movement-following property, minimal compressed feeling when worn, and low wearing deformation.

Example 10

Figure 9:
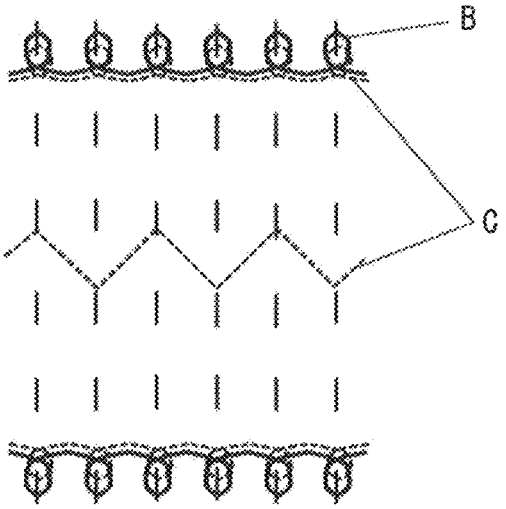
FIG. 9 shows an example of a weave diagram for an elastic circular knitted fabric according to the present embodiment.

Using a 28 gauge double circular knitting machine, and using, as the elastic fibers, 22 dtex polyurethane elastic fibers composed of a prepolymer using polytetramethylene glycol, and 44 dtex/24 f nylon filaments as the nonelastic fibers, a greige was produced with a knitted texture as shown in FIG. 9, having a yarn length of 280 mm/100 W for the non-elastic fibers and a yarn length of 90 mm/100 W for the elastic fiber knitted in parallel with the nonelastic fibers, for a yarn length ratio of 3.11, while the yarn length of the elastic fiber bonded on the front and back was 87 mm/100 W. The greige had knitted loops containing elastic fibers continuously connected in the warp direction of the knitted fabric, the rows of knitted loops containing the connected elastic fibers being arranged on all of the rows in the weft direction of the knitted fabric. After passing the greige through a hot water layer at 80° C., presetting was performed under conditions of 195° C.×60 seconds, with setting of the tentering rate at 0% with respect to the greige width and the compressive shrinkage factor in the warp direction at 0% with respect to the course density of the greige, and dyeing and finishing processing were carried out in the same manner as Example 1 to obtain a fabric. The obtained fabric had a basis weight of 225 g/m$^2$, a course number of 102, a wale number of 57, a course number/wale number ratio of 1.79, a knitted loop aperture angle of 72 degrees for the nonelastic fibers, and a yarn length index of 7240 for the nonelastic fibers. The stretching force of the obtained knitted fabric was 235 cN in the warp direction and 270 cN in the weft direction, for a stretching force ratio of 0.87, the elongation recovery factor was 93% in the warp direction and 95% in the weft direction, the sample sagging in the instantaneous recoverability evaluation was 0.5 mm, and the abrasion resistance was grade 5. The obtained circular knitted fabric was a knitted fabric with excellent warp and weft stretch balance and elongation recovery, a satisfactory movement-following property, minimal compressed feeling when worn, and low wearing deformation.

Comparative Example 1

Figure 10:
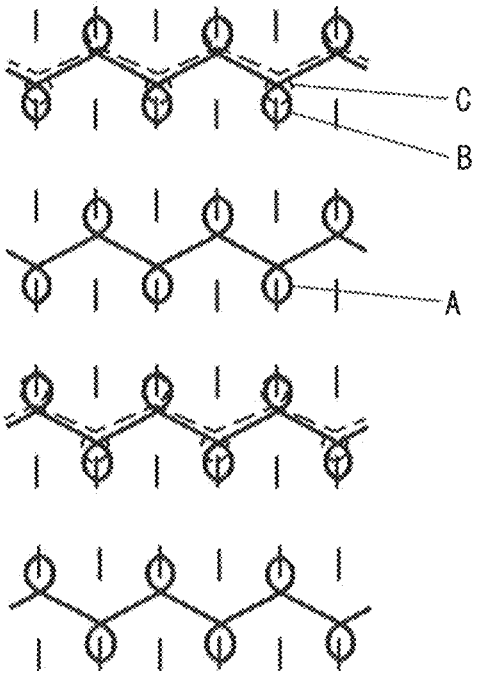
FIG. 10 shows an example of a weave diagram for a conventional knitted fabric.

Using a 28 gauge double circular knitting machine, and using, as the elastic fibers, 33 dtex polyurethane elastic fibers composed of a prepolymer using polytetramethylene glycol, and as the non-elastic fibers, 56 dtex/72 f polyester filaments and 84 dtex/72 f polyester filaments, a greige was produced with a knitted texture as shown in FIG. 10, the non-elastic fiber yarn length being 260 mm/100 W for 56 dtex/72 f and 310 mm/100 W for 84 dtex/72 f, and 179 mm/100 W for the elastic fibers, for a yarn length ratio of 1.73. In the greige, the knitted loops containing elastic fibers were not continuously connected in the warp direction of the knitted fabric, but the rows of knitted loops containing the elastic fibers aligned in the warp direction of the knitted fabric were arranged in a proportion of 1 for every 2 in the weft direction of the knitted fabric. After passing the greige through a hot water layer at 80° C., presetting was performed under conditions of 195° C.×60 seconds, with setting of the tentering rate at 0% with respect to the greige width and the compressive shrinkage factor in the warp direction at 0% with respect to the course density of the greige, and dyeing and finishing processing were carried out in the same manner as Example 1 to obtain a fabric. The obtained fabric was a knitted fabric with a basis weight of 172 g/m$^2$, a course number of 54, a wale number of 37, a course number/wale number ratio of 1.46, a knitted loop aperture angle for the non-elastic fibers of 41 degrees for 56 dtex/72 f and 43 degrees for 84 dtex/72 f, and a yarn length index of 4418 for the non-elastic fibers. The stretching force of the obtained knitted fabric was 392 cN in the warp direction and 183 cN in the weft direction, for a stretching force ratio of 2.14, the elongation recovery factor was 84% in the warp direction and 86% in the weft direction, the sample sagging in the instantaneous recoverability evaluation was 5.8 mm, and the abrasion resistance was grade 4. The obtained circular knitted fabric was a knitted fabric with inferior warp and weft stretch balance and elongation recovery, an unsatisfactory movement-following property, a compressed feeling when worn, and large wearing deformation.

Comparative Example 2

Figure 11:
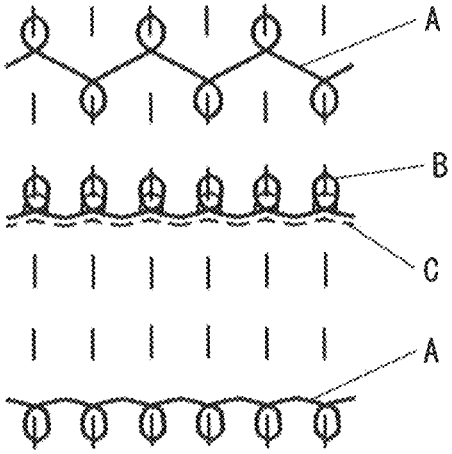
FIG. 11 shows an example of a weave diagram for a conventional knitted fabric.

Using a 22 gauge double circular knitting machine, and using, as the elastic fibers, 44 dtex polyurethane elastic fibers composed of a prepolymer using polytetramethylene glycol, and as the non-elastic fibers, #40 polyester spun yarn, a greige was produced with a knitted texture as shown in FIG. 11, the yarn length for the nonelastic fibers being 315 mm/100 W for one and 260 mm/100 W for the other, and 100 mm/100 W for the elastic fibers, for a yarn length ratio of 2.60. In the greige, the knitted loops containing elastic fibers were not continuously connected in the warp direction of the knitted fabric, but the rows of knitted loops containing the elastic fibers aligned in the warp direction of the knitted fabric were arranged on all of the rows in the weft direction of the knitted fabric. After passing the greige through a hot water layer at 80° C., presetting was performed under conditions of 195° C.×60 seconds, with setting of the tentering rate at +10% with respect to the greige width and the compressive shrinkage factor in the warp direction at 0% with respect to the course density of the greige, and dyeing and finishing processing were carried out in the same manner as Example 1 to obtain a fabric. The obtained fabric was a knitted fabric having a basis weight of 284 g/m$^2$, a course number of 50, a wale number of 35, a course number/wale number ratio of 1.43, a knitted loop aperture angle of 42 degrees for the non-elastic fibers, and a yarn length index of 3928 for the non-elastic fibers. The stretching force of the obtained knitted fabric was 457 cN in the warp direction and 257 cN in the weft direction, for a stretching force ratio of 1.78, the elongation recovery factor was 82% in the warp direction and 86% in the weft direction, the sample sagging in the instantaneous recoverability evaluation was 4.2 mm, and the abrasion resistance was grade 4. The obtained circular knitted fabric was a knitted fabric with inferior warp and weft stretch balance and elongation recovery, an unsatisfactory movement-following property, a compressed feeling when worn, and large wearing deformation.

Comparative Example 3

Using a 22 gauge double circular knitting machine, and using, as the elastic fibers, 44 dtex polyurethane elastic fibers composed of a prepolymer using polytetramethylene glycol, and as the non-elastic fibers, #40 polyester spun yarn, a greige was produced with a knitted texture as shown in FIG. 11, the yarn length for the nonelastic fibers being 315 mm/100 W for one and 260 mm/100 W for the other, and 100 mm/100 W for the elastic fibers, for a yarn length ratio of 2.60. In the greige, the knitted loops containing elastic fibers were not continuously connected in the warp direction of the knitted fabric, but the rows of knitted loops containing the elastic fibers aligned in the warp direction of the knitted fabric were arranged on all of the rows in the weft direction of the knitted fabric. After passing the greige through a hot water layer at 80° C., presetting was performed under conditions of 195° C.×60 seconds, with setting of the tentering rate at +10% with respect to the greige width and the compressive shrinkage factor in the warp direction at −10% with respect to the course density of the greige, and dyeing and finishing processing were carried out in the same manner as Example 1 to obtain a fabric. The obtained fabric was a knitted fabric having a basis weight of 262 g/m$^2$, a course number of 45, a wale number of 35, a course number/wale number ratio of 1.29, a knitted loop aperture angle of 38 degrees for the non-elastic fibers, and a yarn length index of 3655 for the non-elastic fibers. The stretching force of the obtained knitted fabric was 501 cN in the warp direction and 239 cN in the weft direction, for a stretching force ratio of 2.10, the elongation recovery factor was 84% in the warp direction and 86% in the weft direction, the sample sagging in the instantaneous recoverability evaluation was 3.8 mm, and the abrasion resistance was grade 4. The obtained circular knitted fabric was a knitted fabric with inferior warp and weft stretch balance and elongation recovery, an unsatisfactory movement-following property, a compressed feeling when worn, and large wearing deformation.

Comparative Example 4

Using a 28 gauge single circular knitting machine, and using, as the elastic fibers, 33 dtex polyurethane elastic fibers composed of a prepolymer using a copolyether polyol of tetrahydrofuran and a 3-alkyltetrahydrofuran, and as the nonelastic fibers, 84 dtex/72 f polyester filaments, a greige was produced with a knitted texture as shown in FIG. 5, having a yarn length of 324 mm/100 W for the nonelastic fibers and 120 mm/100 W for the elastic fibers, for a yarn length ratio of 2.70. The greige had knitted loops containing elastic fibers continuously connected in the warp direction of the knitted fabric, the rows of knitted loops containing the connected elastic fibers being arranged on all of the rows in the weft direction of the knitted fabric. After passing the greige through a hot water layer at 80° C., presetting was performed under conditions of 185° C.×60 seconds, with setting of the tentering rate at +10% with respect to the greige width and the compressive shrinkage factor in the warp direction at −10% with respect to the course density of the greige, and dyeing and finishing processing were carried out in the same manner as Example 1 to obtain a fabric. The obtained fabric was a knitted fabric having a basis weight of 212 g/m$^2$, a course number of 56, a wale number of 40, a course number/wale number ratio of 1.40, a knitted loop aperture angle of 43 degrees for the nonelastic fibers, and a yarn length index of 4211 for the nonelastic fibers. The stretching force of the obtained knitted fabric was 276 cN in the warp direction and 200 cN in the weft direction, for a stretching force ratio of 1.38, the elongation recovery factor was 91% in the warp direction and 90% in the weft direction, the sample sagging in the instantaneous recoverability evaluation was 1.1 mm, and the abrasion resistance was grade 2.5. The obtained circular knitted fabric was a knitted fabric with excellent warp and weft stretch balance and elongation recovery, a satisfactory movement-following property, minimal compressed feeling when worn, and somewhat low wearing deformation.

TABLE 1

| | | | Example 1 | Example 2 | Example 3 | Example 4 | Example 5 | Example 6 | Example 7 | Example 8 |
|---|---|---|---|---|---|---|---|---|---|---|
| Knitting machine | | | Double | Single | Single | Single | Single | Single | Single | Double |
| Gauge | | | 28 G | 24 G | 28 G | 24 G | 24 G | 24 G | 24 G | 28 G |
| Nonelastic fiber 1 | Description | | Polyester | Polyester | Polyester | Polyester | Polyester | Polyester | Polyester | Polyester |
| | Yarn type | | 56 dtex/72f | #43 | #40 | #43 | #43 | #40 | #43 | 56 dtex/24f |
| | Yarn length mm/100 w | | 260 | 300 | 290 | 250 | 300 | 340 | 312 | 256 |
| Nonelastic fiber 2 | Description | | Polyester | — | — | — | — | Cupra | Polyester | Polyester |
| | Yarn type | | 84 dtex/72f | — | — | — | — | 84 dtex/54f | 84 dtex/36f | 110 dtex/36f |
| | Yarn length mm/100 w | | 310 | — | — | — | — | 320 | 140 | 256 |
| Elastic fiber | Description (prepolymer) | | Polytetra-methylene glycol | Polytetra-methylene glycol | Polytetra-methylene glycol | Polytetra-methylene glycol | Copoly-ether polyol | Polytetra-methylene glycol | Polytetra-methylene glycol | Polytetra-methylene glycol |
| | Yarn type | | 33 dtex | 44 dtex | 20 dtex | 44 dtex | 44 dtex | 22 dtex | 44 dtex | 33 dtex |
| | Yarn length mm/100 w | | 150 | 100 | 96 | 84 | 100 | 108 | 106 | 112 |
| Yarn length ratio | Nonelastic fiber/elastic fiber | | 2.07 | 3.00 | 3.02 | 2.98 | 3.00 | 2.96 | 2.94 | 2.29 |
| Knitted texture | | | Smooth (FIG. 4) | Plain (FIG. 5) | Plain (FIG. 5) | Plain (FIG. 5) | Plain (FIG. 5) | Plain (FIG. 5) | Inlay (FIG. 6) | Kanoko (FIG. 7) |
| Connection in warp direction, of knitted loops containing elastic yarn | | | Good | Good | Good | Good | Good | Good | Good | Good |
| Proportion of rows of knitted loops containing elastic yarn | | | 1 every 2 rows | All rows | All rows | All rows | All rows | All rows | All rows | 1 every 2 rows |
| Presetting conditions | Temperature ° C. | | 195 | 195 | 198 | 195 | 185 | 198 | 198 | 196 |
| | Tenetering rate % | With respect to greige width | −30 | 0 | +3 | +30 | +7 | −4 | −10 | +10 |
| | Compressive shrinkage factor % | With respect to greige course | +38 | 0 | +20 | −15 | +4 | +40 | +25 | +40 |
| Finishing | Basis weight g/m$^2$ | | 190 | 257 | 165 | 127 | 159 | 272 | 255 | 195 |
| | Course number No./inch | | 72 | 82 | 60 | 51 | 85 | 65 | 69 | 57 |
| | Wale number No./inch | | 40 | 46 | 41 | 35 | 48 | 36 | 42 | 35 |
| | Density ratio | Course/well | 1.80 | 1.78 | 1.46 | 1.46 | 1.77 | 1.81 | 1.64 | 1.63 |

TABLE 1-continued

| | | | | | | | | | | |
|---|---|---|---|---|---|---|---|---|---|---|
| Aperture angle of knitted loops of nonelastic fiber | | Nonelastic fiber 1 | 100 | 90 | 52 | 53 | 92 | 118 | 81 | 79 |
| | | Nonelastic fiber 2 | 112 | | | | | 118 | — | 82 |
| At 80% elongation | Stretching force cN | Warp | 261 | 666 | 518 | 766 | 576 | 621 | 390 | 856 |
| | | Weft | 273 | 467 | 290 | 607 | 389 | 384 | 422 | 509 |
| | Stretching force ratio | Warp/weft | 0.95 | 1.43 | 1.79 | 1.26 | 1.48 | 1.62 | 0.92 | 1.68 |
| | Recovery factor % | Warp | 90 | 91 | 87 | 85 | 89 | 90 | 92 | 90 |
| | | Weft | 90 | 90 | 86 | 86 | 91 | 90 | 90 | 91 |
| Yarn length index of nonelastic fiber | | | 8024 | 12586 | 7221 | 4931 | 13613 | 8954 | 8979 | 5615 |
| Abrasion resistance grade | | | 4 | 4 | 4 | 4 | 2.5 | 4 | 4 | 4 |
| Instantaneous recoverability | | Sample sagging mm | 1.7 | 1.5 | 2.4 | 0.9 | 2.7 | 1.9 | 1.4 | 2.0 |
| Deformation when/worn | | | 5 | 5 | 4 | 4 | 4 | 5 | 5 | 5 |

| | | | Example 9 | Example 10 | Comparative Example 1 | Comparative Example 2 | Comparative Example 3 | Comparative Example 4 |
|---|---|---|---|---|---|---|---|---|
| Knitting machine | | | Single | Double | Double | Double | Double | Single |
| Gauge | | | 28 G | 28 G | 28 G | 22 G | 22 G | 28 G |
| Nonelastic fiber 1 | Description | | Polyester | Nylon | Polyester | Polyester | Polyester | Polyester |
| | Yarn type | | 84 dtex/72f | 44 dtex/24f | 56 dtex/72f | #40 | #40 | 84 dtex/72f |
| | Yarn length mm/100 w | | 200 | 280 | 260 | 315 | 315 | 324 |
| Nonelastic fiber 2 | Description | | Cupra | | Polyester | Polyester | Polyester | — |
| | Yarn type | | 84 dtex/54f | | 84 dtex/72f | #40 | #40 | — |
| | Yarn length mm/100 w | | 200 | | 310 | 260 | 260 | — |
| Elastic fiber | Description (prepolymer) | | Polytetra-methylene glycol | Polytetra-methylene glycol | Polytetra-methylene glycol | Polytetra-methylene glycol | Polytetra-methylene glycol | Copoly-ether polyol |
| | Yarn type | | 22 dtex | 22 dtex | 33 dtex | 44 dtex | 44 dtex | 33 dtex |
| | Yarn length mm/100 w | | 67 | 87 | 179 | 100 | 100 | 120 |
| Yarn length ratio | Nonelastic fiber/elastic fiber | | 2.99 | 3.11 | 1.73 | 2.60 | 2.60 | 2.70 |
| Knitted texture | | | Honeycomb (FIG. 8) | Comfort (FIG. 9) | Smooth (FIG. 10) | FIG. 11 | FIG. 11 | Plain (FIG. 5) |
| Connection in warp direction, of knitted loops containing elastic yarn | | | Good | Good | Sad | Bad | Bad | Good |
| Proportion of rows of knitted loops containing elastic yarn | | | All rows | All rows | 1 every 2 rows | All rows | All rows | All rows |
| Presetting conditions | Temperature ° C. | | 195 | 195 | 195 | 195 | 195 | 185 |
| | Tenetering rate % | With respect to greige width | +3 | 0 | 0 | +10 | +10 | +10 |
| | Compressive shrinkage factor % | With respect to greige course | +20 | 0 | 0 | 0 | −10 | −10 |
| Finishing | Basis weight g/m$^2$ | | 160 | 225 | 172 | 284 | 262 | 212 |
| | Course number No./inch | | 133 | 102 | 54 | 50 | 45 | 56 |
| | Wale number No./inch | | 60 | 57 | 37 | 35 | 35 | 40 |
| | Density ratio | Course/well | 2.22 | 1.79 | 1.46 | 1.43 | 1.29 | 1.40 |
| | Aperture angle of knitted loops of nonelastic fiber | Nonelastic fiber 1 | 126 | 72 | 43 | 42 | 38 | 43 |
| | | Nonelastic fiber 2 | 102 | | 46 | 51 | 44 | |
| | At 80% elongation | Stretching force cN: Warp | 655 | 235 | 392 | 457 | 501 | 276 |
| | | Stretching force cN: Weft | 423 | 270 | 183 | 257 | 239 | 200 |
| | | Stretching force ratio: Warp/weft | 1.55 | 0.87 | 2.14 | 1.78 | 2.10 | 1.38 |
| | | Recovery factor %: Warp | 91 | 93 | 84 | 82 | 84 | 91 |
| | | Recovery factor %: Weft | 90 | 95 | 86 | 86 | 86 | 90 |
| | Yarn length index of nonelastic fiber | | 13652 | 7240 | 4418 | 3928 | 3655 | 4211 |
| | Abrasion resistance grade | | 4 | 5 | 4 | 4 | 4 | 2.5 |
| | Instantaneous recoverability | Sample sagging mm | 1.9 | 0.5 | 5.8 | 4.2 | 3.8 | 1.1 |
| | Deformation when/worn | | 5 | 5 | 2 | 2 | 2 | 3 |

INDUSTRIAL APPLICABILITY

By using the elastic circular knitted fabric of the invention it is possible to produce clothing having excellent extensibility and recoverability, as well as an excellent movement-following property and feel during wear, that is suitable for clothing such as inner wear, sports wear, swimming wear, casual wear and the like.

EXPLANATION OF SYMBOLS

A Non-elastic fiber
B Non-elastic fiber forming same loop as elastic fiber
C Elastic fiber
1*a*-1*c*, 3*a*-3*c*, 5*a*-5*c* Knitted loops comprising elastic fiber and nonelastic fiber
2*a*-2*c*, 4*a*-4*c* Knitted loops comprising nonelastic fiber alone
D Center line of top left fiber bundle, forming knitted loop of non-elastic fiber
E Center line of top right fiber bundle, forming knitted loop of non-elastic fiber
F Aperture angle
6*a* Sample holder
6*b* Sample-fixing frame
6*c* Movable sample holder
6*d* Thrusting rod

What is claimed is:

1. An elastic circular knitted fabric composed of elastic fibers and nonelastic fibers, wherein knitted loops including elastic fibers are continuously connected in the warp direction of the knitted fabric, the rows of knitted loops are arranged in a proportion of at least 1 for every 2 rows in the weft direction of the knitted fabric, the aperture angle of the fiber bundles forming the knitted loops of the non-elastic fibers is 50 to 150 degrees, the stretching force in the warp direction and the stretching force in the weft direction at 80% elongation of the elastic circular knitted fabric are both 100 to 800 cN, the ratio of stretching force in the warp direction/stretching force in the weft direction is 0.5 to 1.8, and the elongation recovery factor in the warp direction and the elongation recovery factor in the weft direction are both 85% or greater, when 80% elongation and recovery have been repeated 3 times.

2. An elastic circular knitted fabric according to claim 1, wherein the yarn length index of the nonelastic fibers per square inch of knitted fabric is 5000 to 15,000.

3. An elastic circular knitted fabric according to claim 1 or 2, wherein the ratio of: density in the warp direction/density in the weft direction is 1.5 to 2.0.

4. An elastic circular knitted fabric according to claim 1, wherein the size (finness) of the elastic fibers is 15 to 80 dtex.

5. An elastic circular knitted fabric according to claim 1, wherein the basis weight is 100 to 400 g/m$^2$.

6. An elastic circular knitted fabric according to claim 1, wherein the abrasion resistance is grade 3 or higher.

7. An elastic circular knitted fabric according to claim 1, wherein the knitted fabric is a single jersey texture, and the nonelastic fibers include at least two types.

8. An elastic circular knitted fabric according to claim 1, wherein the knitted fabric is an inlay texture, the non-elastic fibers to be inlay knitted on the back side of the knitted fabric are in a 1- to 3-over stitch, and at least one of the types of nonelastic fibers is crimped.

9. An elastic circular knitted fabric according to claim 1, wherein the knitted fabric is a moss stitch.

10. An elastic circular knitted fabric according to claim 1, wherein the knitted fabric is a honeycomb stitch.

11. An elastic circular knitted fabric according to claim 1, that includes cellulose fibers.

* * * * *